US012104619B2

(12) United States Patent
Chen et al.

(10) Patent No.: US 12,104,619 B2
(45) Date of Patent: Oct. 1, 2024

(54) HEAD SHAKING DEVICE AND FAN

(71) Applicant: Gree Electric Appliances, Inc. of ZHUHAI, Zhuhai (CN)

(72) Inventors: Zhicong Chen, Zhuhai (CN); Peide Zhang, Zhuhai (CN); Zhe Cao, Zhuhai (CN); Zhengchao Chen, Zhuhai (CN); Yuliang Xu, Zhuhai (CN); Shaohua Chen, Zhuhai (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 0 days.

(21) Appl. No.: 18/002,741

(22) PCT Filed: May 18, 2021

(86) PCT No.: PCT/CN2021/094328
§ 371 (c)(1),
(2) Date: Dec. 21, 2022

(87) PCT Pub. No.: WO2022/052502
PCT Pub. Date: Mar. 17, 2022

(65) Prior Publication Data

US 2023/0235754 A1 Jul. 27, 2023

(30) Foreign Application Priority Data

Sep. 11, 2020 (CN) ..... 202010956260.1

(51) Int. Cl.
*F04D 29/66* (2006.01)
*F04D 19/00* (2006.01)

(52) U.S. Cl.
CPC ..... *F04D 29/668* (2013.01); *F04D 19/00* (2013.01)

(58) Field of Classification Search
CPC ..... F04D 19/00; F04D 25/105; F04D 29/668
See application file for complete search history.

(56) References Cited

U.S. PATENT DOCUMENTS

2014/0165452 A1* 6/2014 Rocha ..... A01M 1/08 43/139
2020/0011338 A1 1/2020 Lin et al.

FOREIGN PATENT DOCUMENTS

CN 202732397 U 2/2013
CN 203463323 U * 3/2014
CN 204062340 U * 12/2014
(Continued)

OTHER PUBLICATIONS

CN-108119380 (Jun. 2018; Mai et al.) English Translation (Year: 2023).*
(Continued)

*Primary Examiner* — J. Todd Newton
*Assistant Examiner* — Aye S Htay
(74) *Attorney, Agent, or Firm* — Armstrong Teasdale LLP

(57) ABSTRACT

Some embodiments of the present disclosure provides a head shaking device and a fan. The head shaking device includes a fixing assembly; and a rotating assembly, which rotates relative to the fixing assembly in a reciprocating manner, wherein one of the fixing assembly and the rotating assembly includes at least one first connecting structure, the other includes at least one second connecting structure, and the first connecting structure is rotatably clamped with the second connecting structure.

19 Claims, 5 Drawing Sheets

(56) References Cited

FOREIGN PATENT DOCUMENTS

| | | | | | |
|---|---|---|---|---|---|
| CN | 107514381 | A | * | 12/2017 | ..... F04D 25/105 |
| CN | 108119380 | A | * | 6/2018 | ..... F04D 25/105 |
| CN | 208123106 | U | | 11/2018 | |
| CN | 110159571 | A | | 8/2019 | |
| CN | 110159574 | A | | 8/2019 | |
| CN | 111237855 | A | | 6/2020 | |
| CN | 111637084 | A | | 9/2020 | |
| CN | 212318350 | U | | 1/2021 | |
| JP | 3145283 | U | | 10/2008 | |

OTHER PUBLICATIONS

CN 107514381 (Dec. 2017; Luo et al.) English Translation (Year: 2023).*
CN 203463323 (Mar. 2014; Zheng et al.) English Translation (Year: 2023).*
English Translation of CN 204062340 (Zhao et al.; Dec. 31, 2014). (Year: 2024).*
International Search Report for corresponding International Patent App. No. PCT/CN2021/094328, mailed Aug. 20, 2021, 3 pages.

* cited by examiner

HEAD SHAKING DEVICE AND FAN

CROSS-REFERENCE TO RELATED APPLICATIONS

The present disclosure is a National Stage application of PCT/CN2021/094328, filed on May 18, 2021, which claims the priority of Chinese Patent Application 202010956260. 1, filed in the Chinese Patent Office on Sep. 11, 2020, and entitled "Head Shaking Device and Fan", the entire contents of which are herein incorporated by reference in their entirety.

TECHNICAL FIELD

The present disclosure relates to a technical field of household appliances, and in particular to a head shaking device and a fan.

BACKGROUND

In nowadays society, fans have become an indispensable part in people's lives. In order to expand the blowing areas of the fans, head shaking devices are generally provided on the fans. The existing head shaking devices mostly uses four-bar mechanisms to expand the blowing areas.

The existing head shaking device includes a fixing bracket and a turntable, the fixing bracket or the turntable is provided with a hollow shaft, the turntable or the fixing bracket is provided with a fixing hole, and the hollow shaft is cooperatively connected with the fixing hole. A motor is configured to control the turntable to rotate relative to the fixing bracket, the fixing bracket is inserted into the fixing hole by means of a hollow shaft sleeve, so as to realize the connection with the turntable, and then the relative rotation between the fixing bracket and the turntable is realized by means of the four-bar mechanism, so as to realize a head shaking function.

However, in the above art, since the hollow shaft is a hollow rod member, which usually has flexibility, shaking is easy to occur during a head shaking process, which affects the stability of head shaking, and meanwhile, noise is generated, thus affecting the user experience.

SUMMARY

Therefore, a technical problem to be solved by some embodiments of the present disclosure is to overcome the defect that a head shaking mechanism in the art known to inventors is prone to shaking during head shaking due to the flexibility of a hollow shaft, so as to provide a head shaking device and a fan, wherein the head shaking device utilizes a rotary clamping manner and has no flexibility, such that the head shaking stability is good, and shaking is unlikely to happen.

A head shaking device, including:

a fixing assembly; and a rotating assembly, which rotates relative to the fixing assembly in a reciprocating manner, wherein one of the fixing assembly and the rotating assembly includes at least one first connecting structure, the other includes at least one second connecting structure, and the first connecting structure is rotatably clamped with the second connecting structure.

In some embodiments, a central angle corresponding to an assembly path, on which the rotating assembly rotates relative to the fixing assembly so as to realize rotary clamping, is a first central angle, a central angle corresponding to a head shaking path, on which the rotating assembly rotates relative to the fixing assembly in the reciprocating manner, is a second central angle, and at least part of the first central angle does not coincide with the second central angle.

In some embodiments, the first connecting structure includes a first rotary clamping protrusion, the second connecting structure includes a second rotary clamping protrusion, the first connecting structure forms a clamping space on one side on which the first rotary clamping protrusion faces away from the second connecting structure, and the second rotary clamping protrusion has an assembly state in which at least part of the second rotary clamping protrusion rotates into the clamping space when rotating by the first central angle, and a head shaking state in which at least part of the second rotary clamping protrusion is limited in the clamping space when rotating by the second central angle in the reciprocating manner.

In some embodiments, the first connecting structure includes a first rotary clamping protrusion, the second connecting structure includes a second rotary clamping protrusion, the first connecting structure forms a clamping space on one side on which the first rotary clamping protrusion faces away from the second connecting structure, and the second rotary clamping protrusion has a first state of being limited in the clamping space, and a second state of deviating from the clamping space.

In some embodiments, the first connecting structure includes a rotating groove, the first rotary clamping protrusion is a groove wall of the rotating groove, and the second rotary clamping protrusion has the first state of being limited in the rotating groove, and the second state of deviating from the rotating groove.

In some embodiments, the first connecting structure further includes inlet grooves, each of the inlet grooves at least communicates with one rotating groove, and the second rotary clamping protrusion enters the rotating groove by means of the inlet groove.

In some embodiments, the inlet groove communicates with the rotating groove in a circumferential direction, so as to form a groove-shaped structure with an opening which faces an axis of the rotating assembly, and the second rotary clamping protrusion protrudes toward a direction away from the axis of the rotating assembly.

In some embodiments, the fixing assembly includes the at least one first connecting structure, the at least one the first connecting structures are distributed in the circumferential direction of the fixing assembly and communicate with each other in sequence, and the inlet groove and the rotating groove form an annular groove with an opening which faces the axis of the rotating assembly.

In some embodiments, the at least one first connecting structure are disposed on a radial edge of the fixing assembly and are evenly distributed in the circumferential direction of the fixing assembly; and the second connecting structures are correspondingly disposed on the radial edge of the rotating assembly and are evenly distributed in the circumferential direction of the rotating assembly.

In some embodiments, the fixing assembly includes a fixing body, and a flange disposed on one end of the fixing body which faces the rotating assembly, and the flange protrudes from an outer peripheral wall of the fixing body; an end wall of the flange, which faces away from the rotating assembly, forms a first groove wall of the annular groove; the outer peripheral wall of the flange forms a groove bottom wall of the annular groove; and one end of the flange, which faces the rotating assembly, extends toward the axis of the rotating assembly, so as to form a second groove wall of the annular groove.

In some embodiments, the second groove wall is provided with at least one notch, the annular groove located at the notch is the inlet groove, and the second rotary clamping protrusion enters the inlet groove by means of the notch.

In some embodiments, the notch extends from an opening of the annular groove toward the direction of the groove bottom wall of the annular groove, so as to form an arc-shaped notch, and a shape of the second rotary clamping protrusion matches a shape of the notch.

In some embodiments, an end surface of the rotating assembly, which faces the fixing assembly, is provided with a protruding portion which protrudes toward the fixing assembly, and the second rotary clamping protrusion is disposed on the outer peripheral wall of the protruding portion.

In some embodiments, the protruding portion is annular, and the second rotary clamping protrusion is disposed on one end of the outer peripheral wall of the protruding portion, which is away from the rotating assembly.

In some embodiments, the head shaking device further includes a rolling body assembly, which is disposed between the fixing assembly and the rotating assembly, and is in rolling fit with the fixing assembly and the rotating assembly, respectively.

In some embodiments, the rolling body assembly is a ball assembly, the ball assembly includes a ball plate which is provided with a ball groove, and a ball which is rotatably disposed in the ball groove, and the ball is disposed to protrude from two end surfaces of the ball plate.

In some embodiments, the head shaking device further includes a first friction ring and a second friction ring, one end surface of the first friction ring is connected with the rotating assembly, and the other end surface thereof is provided with a first slideway matching the ball; and one end surface of the second friction ring is connected with the fixing assembly, and the other end surface thereof is provided with a second slideway matching the ball.

In some embodiments, the first friction ring is provided with at least one positioning block or positioning cavity, and the rotating assembly is provided with a matched positioning cavity or positioning block; and the second friction ring is provided with at least one positioning block or positioning cavity, and the fixing assembly is provided with a matched positioning cavity or positioning block.

In some embodiments, one of the rotating assembly and the fixing assembly includes a rotating shaft in an axial direction, and the other includes a shaft hole matching the rotating shaft.

In some embodiments, the head shaking device further includes a shaft sleeve, which is sleeved inside the shaft hole and is sleeved outside the rotating shaft.

An outer periphery of the shaft sleeve is provided with a limiting portion for fixing the shaft sleeve, and an inner periphery of the shaft hole is provided with a matching portion which matches the limiting portion.

A fan, including the above-mentioned head shaking device.

The technical solutions of the present disclosure have the following advantages:

1. The head shaking device provided by the present disclosure includes the fixing assembly and the rotating assembly, by means of the rotary clamping between the first connecting structure and the second connecting structure, the defect of a head shaking mechanism in the art known to inventors of being prone to shake during head shaking due to the flexibility of a hollow shaft is overcome, the head shaking stability is good, and shaking is unlikely to happen. In addition, by means of the rotary clamping, the fixing assembly and the rotating assembly are simple to be connected and are convenient to installed and disassembled.

2. In the head shaking device provided by the present disclosure, at least part of the first central angle does not coincide with the second central angle, thereby ensuring that the rotating assembly is always rotatably clamped with the fixing assembly in the head shaking process, such that the head shaking stability is good, and shaking is unlikely to happen.

3. The clamping space provided by the present disclosure limits the second rotary clamping protrusion.

4. The first connecting structure provided by the present disclosure includes the rotating groove, at least part of the second rotary clamping protrusion enters the rotating groove for rotary clamping, and at least part of the second rotary clamping protrusion is limited in the rotating groove, so as to rotate in the reciprocating manner. Therefore, the structure is simple, and the cooperation is convenient.

5. The first connecting structure provided by the present disclosure further includes the inlet groove, thereby providing an inlet for the second rotary clamping protrusion to enter the rotating groove, without affecting the rotating groove from limiting the second rotary clamping protrusion. The second rotary clamping protrusion enters the inlet groove, enters the rotating groove from a communication location of the inlet groove and the rotating groove, and rotates in the rotating groove in the reciprocating manner.

6. The inlet groove provided by the present disclosure communicates with the rotating groove in the circumferential direction, such that it is more convenient for the second rotary clamping protrusion to enter the rotating groove. The direction of the opening of the groove-shaped structure is opposite to the protruding direction of the second rotary clamping protrusion, such that it is more convenient for the second rotary clamping protrusion to enter the rotating groove from the inlet groove, and the second rotary clamping protrusion is limited in the rotating groove.

7. The annular groove provided by the present disclosure has a simple structure, and can provide a greater rotating groove or more rotating grooves, such that the limiting effect is better, and the stability of reciprocating rotation is higher.

8. The first connecting structures in the present disclosure are disposed on the radial edge of the fixing assembly and are evenly distributed in the circumferential direction; and the second connecting structures are correspondingly disposed on the radial edge of the rotating assembly, and are evenly distributed in the circumferential direction. Therefore, the structure is convenient to be formed, and the limiting of the second rotary clamping protrusion by the rotating groove is uniform and stable.

9. The second groove wall in the present disclosure is provided with the notch, such that the structure is simple, and the inlet groove can be conveniently formed.

10. The notch in the present disclosure is an arc-shaped notch, thereby being simple in structure and convenient to form, and avoiding sharp edges and corners.

11. The protruding portion in the present disclosure cooperates with other assemblies, so as to support the rotating assembly at a certain distance from the fixing assembly, thereby reducing the friction between the rotating assembly and the fixing assembly.

12. The protruding portion in the present disclosure is annular, thereby being high in strength and unlikely to be damaged. The second rotary clamping protrusion is disposed on one end of the outer peripheral wall of the protruding portion, which is away from the rotating assembly, thereby reducing the damage to the fixing assembly by the end portion of the protruding portion, which is away from the rotating assembly.

13. By means of the rolling body assembly in the present disclosure, the rotating assembly is supported above the fixing assembly, such that the first connecting structure and the second connecting structure are not in direct contact with each other, so as to prevent damage or noise caused by friction therebetween; and the rotating fit between the fixing assembly and the rotating assembly is realized by the rolling fit between the rotating assembly and the rolling body assembly and the rolling fit between the fixing assembly and the rolling body assembly, and the contact mode in the cooperation process is point contact or line contact, such that the head shaking process of the fan is smoother and more stable.

14. The rolling body assembly in the present disclosure is a ball assembly, which is relatively common and is convenient to be processed and formed.

15. The head shaking device in the present disclosure further includes the first friction ring and the second friction ring, thereby withstanding a frictional force and preventing damage to the fixing assembly and the rotating assembly; and in a rotating process of the rotating assembly relative to the fixing assembly, the ball is accommodated and limited in the first slideway and the second slideway for moving, such that the stability of the rotating assembly in the head shaking process is better.

16. In the present disclosure, the first friction ring is provided with the positioning block or positioning cavity, so as to cooperate with the rotating assembly, such that relative rotation will not occur, and the installation and disassembly are convenient; and the second friction ring is provided with the positioning block or positioning cavity, so as to cooperate with the fixing assembly, such that relative rotation will not occur, and the installation and disassembly are convenient.

17. By means of the cooperation between the rotating shaft and the shaft hole in the present disclosure, an installation pressure between the first connecting structure and the second connecting structure is shared, meanwhile, the rotary connection between the fixing assembly and the rotating assembly is stabilized, and the head shaking stability is enhanced.

BRIEF DESCRIPTION OF THE DRAWINGS

To illustrate technical solutions in specific embodiments of the present disclosure or in the art known to inventors more clearly, a brief introduction on the drawings which are needed in the description of the specific embodiments or the art known to inventors is given below. Apparently, the drawings in the description below are merely some of the embodiments of the present disclosure, based on which other drawings may be obtained by those of ordinary skill in the art known to inventors without any creative effort.

DESCRIPTION OF REFERENCE SIGNS

Figure 1:
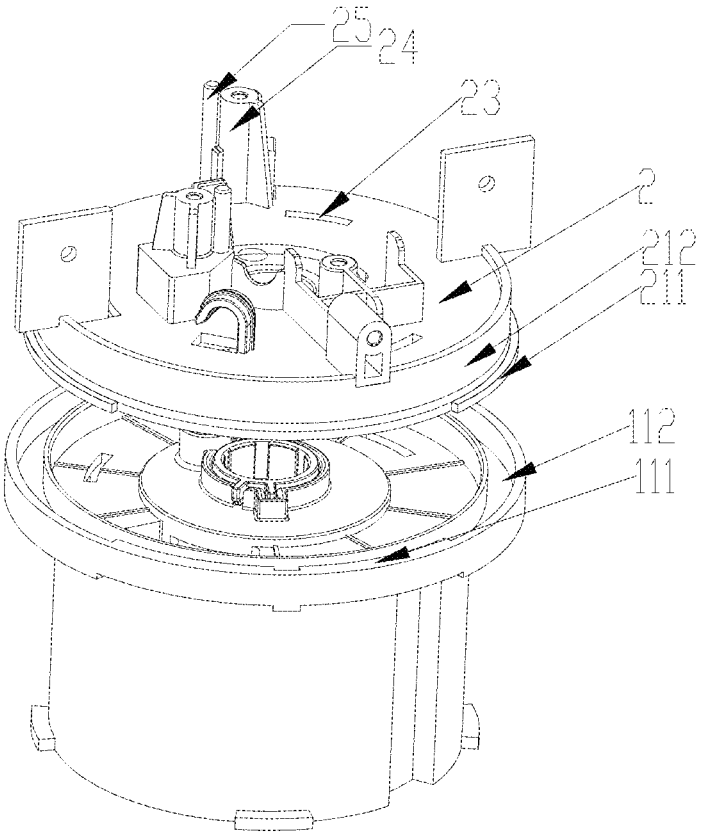
FIG. 1 illustrates an exploded view of installation of a head shaking device provided in a first embodiment of the present disclosure.
Figure 2:
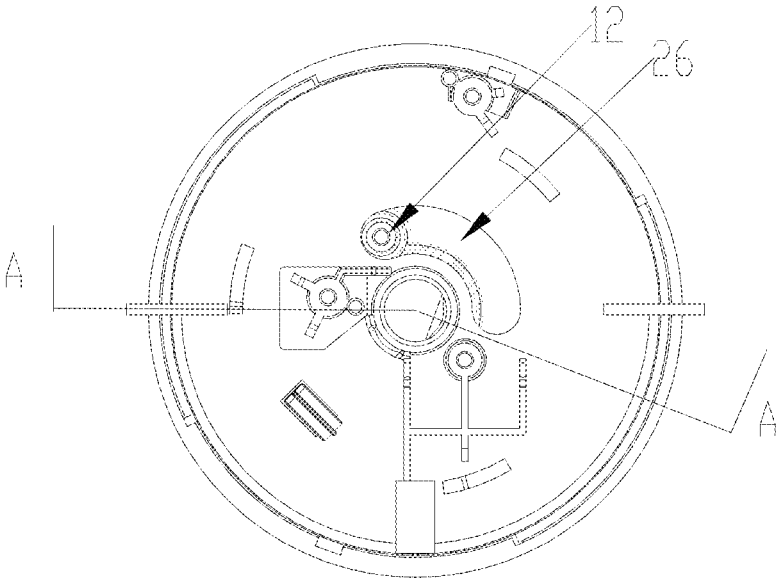
FIG. 2 illustrates a top view of the head shaking device shown in FIG. 1.
Figure 3:
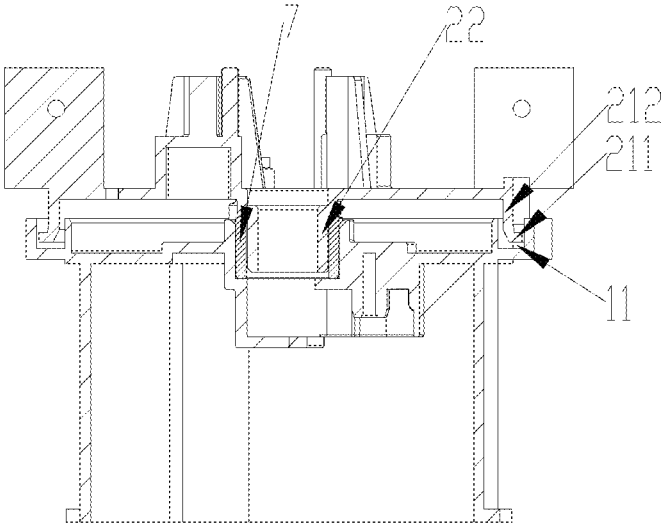
FIG. 3 illustrates A-A sectional view of FIG. 2.

1, fixing assembly; 11, first connecting structure; 111, rotating groove; 112, inlet groove; 113, flange; 114, groove bottom wall of the annular groove; 115, first groove wall; 116, second groove wall; 12, rocker; 13, shaft hole; 14, supporting portion; 2, rotating assembly; 21, second connecting structure; 211, second rotary clamping protrusion; 212, protruding portion; 22, rotating shaft; 23, positioning cavity; 24, connecting column; 25, limiting column; 26, rotating hole; 3, driving assembly; 31, motor; 32, crank; 33, connecting rod; 4, ball assembly; 41, ball plate; 42, ball; 5, first friction ring; 51, positioning block; 6, second friction ring; 61, second slideway; 7, shaft sleeve.

DETAILED DESCRIPTION OF THE EMBODIMENTS

A clear and complete description of technical solutions of the present disclosure will be given below, in combination with the drawings. Apparently, the embodiments described below are merely a part, but not all, of the embodiments of the present disclosure. All of other embodiments, obtained by those of ordinary skill in the art based on the embodiments of the present disclosure without any creative effort, fall into the protection scope of the present disclosure.

In the description of the present disclosure, it should be noted that orientation or position relationships indicated by terms “center”, “upper”, “lower”, “left”, “right”, “vertical”, “horizontal”, “inside”, “outside” and the like are orientation or position relationships shown on the basis of the drawings, and are merely for the convenience of describing the present disclosure and simplifying the description, but do not indicate or imply that the referred devices or elements must have specific orientations or must be constructed and operated in specific orientations, and thus cannot be construed as limitations to the present disclosure. In addition, the terms “first”, “second” and “third” are used for descriptive purposes only, and should not be construed to indicate or imply relative importance.

In the description of the present disclosure, it should be noted that, unless otherwise expressly specified and limited, the terms “installed”, “connected” and “connection” should be understood in a broad sense. For example, the connection may be a fixed connection, and may also be a detachable connection, or an integral connection; may be a mechanical connection, and may also be an electrical connection; and may be a direct connection, may be an indirect connection through an intermediate medium, and may also be internal communication between two elements. For those of ordinary skill in the art, the specific meanings of the above terms in the present disclosure may be understood in specific situations.

In addition, technical features involved in different embodiments of the present disclosure described below may be combined with each other as long as they do not conflict with each other.

As shown in FIGS. 1-7, the present embodiment provides a head shaking device, including a fixing assembly 1 and a rotating assembly 2, wherein the rotating assembly 2 rotates relative to the fixing assembly 1 in a reciprocating manner, one of the fixing assembly 1 and the rotating assembly 2 includes at least one first connecting structure 11, the other includes at least one second connecting structure 21, and the first connecting structure 11 is rotatably clamped with the second connecting structure 21.

By means of the rotary clamping between the first connecting structure 11 and the second connecting structure 21, the head shaking device overcomes the defect of a head shaking mechanism in the related art of being prone to shake during head shaking due to the flexibility of a hollow shaft, such that the head shaking stability is good, and shaking is unlikely to happen. In addition, by means of the rotary clamping, the fixing assembly 1 and the rotating assembly 2 are simple to be connected and are convenient to be installed and disassembled. The head shaking device includes two implementation modes, that is, the fixing assembly 1 includes the first connecting structure 11, and the rotating assembly 2 includes the second connecting structure 21; or, the fixing assembly 1 includes the second connecting structure 21, and the rotating assembly 2 includes the first connecting structure 11.

In the present embodiment, a central angle corresponding to an assembly path, on which the rotating assembly 2 rotates relative to the fixing assembly 1 so as to realize rotary clamping, is a first central angle, a central angle corresponding to a head shaking path, on which the rotating assembly 2 rotates relative to the fixing assembly 1 in the reciprocating manner, is a second central angle, and at least part of the first central angle does not coincide with the second central angle. Therefore, it is ensured that the rotating assembly 2 is always rotatably clamped with the fixing assembly 1 in the head shaking process, such that the head shaking stability is good, and shaking is unlikely to happen.

In the present embodiment, the first connecting structure 11 includes a first rotary clamping protrusion, the second connecting structure 21 includes a second rotary clamping protrusion 211, the first connecting structure forms a clamping space on one side on which the first rotary clamping protrusion faces away from the second connecting structure, and the second rotary clamping protrusion 211 has an assembly state in which at least part of the second rotary clamping protrusion 211 rotates into the clamping space when rotating by the first central angle, and a head shaking state in which at least part of the second rotary clamping protrusion 211 is limited in the clamping space when rotating by the second central angle in the reciprocating manner.

In the present embodiment, the first connecting structure 11 includes a first rotary clamping protrusion, the second connecting structure 21 includes a second rotary clamping protrusion 211, the first connecting structure forms a clamping space on one side on which the first rotary clamping protrusion faces away from the second connecting structure, and the second rotary clamping protrusion 211 has a first state of being limited in the clamping space, and a second state of deviating from the clamping space. The clamping space limits the second rotary clamping protrusion 211 by means of the first rotary clamping protrusion.

When the rotating assembly 2 rotates relative to the fixing assembly 1 by the first central angle, at least part of the second rotary clamping protrusion 211 rotates into the clamping space, and at least part of the second rotary clamping protrusion 211 coincides with the first rotary clamping protrusion in the axial direction of the rotating assembly 2, so as to limit the second rotary clamping protrusion, thereby preventing the second rotary clamping protrusion 211 from offsetting toward a direction away from the first rotary clamping protrusion, or preventing the second rotary clamping protrusion 211 from deviating from the first connecting structure, so as to ensure the rotary clamping effect of the first connecting structure and the second connecting structure. When the rotating assembly 2 rotates relative to the fixing assembly 1 in the reciprocating manner by the second central angle, at least part of the second rotary clamping protrusion 211 rotates in the clamping space in the reciprocating manner, and at least part of the second rotary clamping protrusion 211 coincides with the first rotary clamping protrusion in the axial direction of the rotating assembly 2, so as to limit the second rotary clamping protrusion, such that no shaking is generated in the head shaking process.

In the present embodiment, the first connecting structure 11 includes a rotating groove 111, the first rotary clamping protrusion is a groove wall of the rotating groove 111, and the second rotary clamping protrusion 211 has a first state of being limited in the rotating groove 111, and a second state of deviating from the rotating groove 111. When the rotating assembly 2 rotates by the first central angle, at least part of the second rotary clamping protrusion 211 rotates into the rotating groove 111 and is limited in the rotating groove 111; and when the second rotary clamping protrusion 211 rotates in the reciprocating manner by the second central angle, at least part of the second rotary clamping protrusion is limited in the rotating groove 111. Therefore, the structure is simple, and the cooperation is convenient. The clamping space is formed inside the rotating groove 111.

In some embodiments, the two ends of the first rotary clamping protrusion are respectively supported on the fixing assembly or the rotating assembly by means of supporting elements, and a space between the first rotary clamping protrusion and the fixing assembly or the rotating assembly forms the clamping space.

In the present embodiment, the first connecting structure 11 further includes inlet grooves 112, each of the inlet grooves 112 at least communicates with one rotating groove 111, and the second rotary clamping protrusion 211 enters the rotating groove 111 by means of the inlet groove 112. Therefore, an inlet is provided for the second rotary clamping protrusion 211 to enter the rotating groove 111, without affecting the rotating groove 111 from limiting the second rotary clamping protrusion 211. The second rotary clamping protrusion 211 enters the inlet groove 112, enters the rotating groove 111 from a communication location of the inlet groove 112 and the rotating groove 111, and rotates in the rotating groove 111 in the reciprocating manner.

In the present embodiment, the inlet groove 112 communicates with the rotating groove 111 in the circumferential direction, so as to form a groove-shaped structure with an opening which faces the axis of the rotating assembly 2, and the second rotary clamping protrusion 211 protrudes toward a direction away from the axis of the rotating assembly 2. Therefore, it is more convenient for the second rotary clamping protrusion 211 to enter the rotating groove 111. The direction of the opening of the groove-shaped structure is opposite to the protruding direction of the second rotary clamping protrusion 211, such that it is more convenient for the second rotary clamping protrusion 211 to enter the rotating groove 111 from the inlet groove 112, and the second rotary clamping protrusion is limited in the rotating groove 111. The distance between two groove walls of the rotating groove 111 is the same as the distance between the groove walls of the inlet groove 112; or, the distance between two groove walls of the rotating groove 111 is less than the distance between the groove walls of the inlet groove 112.

In some embodiments, the inlet groove 112 communicates with the rotating groove 111 in the circumferential direction, so as to form a groove-shaped structure with an opening which faces away from the axis of the rotating assembly 2, and the second rotary clamping protrusion 211 protrudes toward the direction of the axis of the rotating assembly 2.

In the present embodiment, the fixing assembly 1 includes at least one first connecting structure 11, the first connecting structures 11 are distributed in the circumferential direction of the fixing assembly 1 and communicate with each other in sequence, and the inlet groove 112 and the rotating groove 111 form an annular groove with an opening which faces the axis of the rotating assembly 2. The structure is simple, and a greater rotating groove 111 or more rotating grooves 111 can be provided, such that the limiting effect is better, and the stability of reciprocating rotation is higher.

As shown in FIGS. 1-7, the at least one first connecting structure 11 are disposed on a radial edge of the fixing assembly 1 and are evenly distributed in the circumferential direction of the fixing assembly 1; and the second connecting structures 21 are correspondingly disposed on the radial edge of the rotating assembly 2 and are evenly distributed in the circumferential direction of the rotating assembly 2. Therefore, the structure is convenient to be formed, and the limiting of the second rotary clamping protrusion 211 by the rotating groove 111 is uniform and stable.

As shown in FIG. 1, the fixing assembly 1 includes a fixing body, and a flange 113 disposed on one end of the fixing body which faces the rotating assembly 2, and the flange 113 protrudes from an outer peripheral wall of the fixing body; an end wall of the flange, which faces away from the rotating assembly 2, forms a first groove wall 115 of the annular groove; the outer peripheral wall of the flange forms a groove bottom wall of the annular groove 114; and one end of the flange, which faces the rotating assembly 2, extends toward the axis of the rotating assembly 2, so as to form a second groove wall 116 of the annular groove.

In the present embodiment, the second groove wall 116 is provided with at least one notch, the annular groove located at the notch is an inlet groove 112, and the second rotary clamping protrusion 211 enters the inlet groove 112 by means of the notch. In this way, the structure is simple, and the inlet groove 112 can be conveniently formed.

In the present embodiment, the notch extends from the opening of the annular groove toward the direction of the groove bottom wall, so as to form an arc-shaped notch, and the shape of the second rotary clamping protrusion 211 matches the shape of the notch. Therefore, the structure is simple, molding is convenient, and sharp edges and corners are avoided.

As shown in FIG. 1, an end surface of the rotating assembly 2, which faces the fixing assembly 1, is provided with a protruding portion 212 which protrudes toward the fixing assembly 1, and the second rotary clamping protrusion 211 is disposed on the outer peripheral wall of the protruding portion 212. The protruding portion 212 cooperates with other assemblies, so as to support the rotating assembly 2 at a certain distance from the fixing assembly 1, thereby reducing the friction between the rotating assembly 2 and the fixing assembly 1.

The protruding portion 212 is annular, thereby being high in strength and unlikely to be damaged. The second rotary clamping protrusion 212 is disposed on one end of the outer peripheral wall of the protruding portion 212, which is away from the rotating assembly 2, thereby reducing the damage to the fixing assembly 1 by the end portion of the protruding portion 212, which is away from the rotating assembly 2.

As shown in FIG. 1, in the present embodiment, one end of the fixing body which faces the rotating assembly 2 further includes a supporting portion 14, and the supporting portion 14 is disposed in an inner ring of the annular groove. In some embodiments, the protruding portion 212 is sandwiched between the supporting portion 14 and the annular groove, and the distance between the second groove wall and the first groove wall is equal to a height of the supporting portion 14 protruding from the fixing body.

Figure 4:
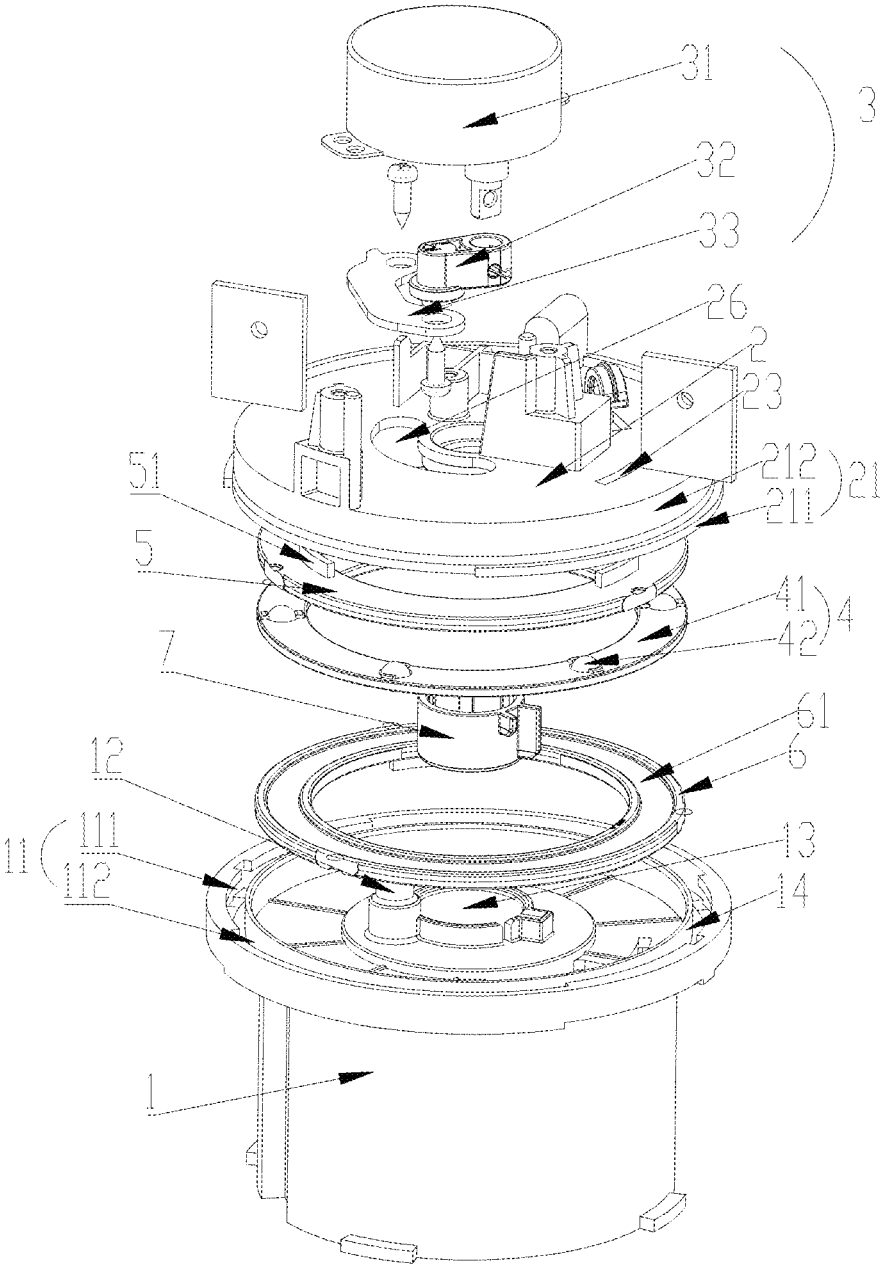
FIG. 4 illustrates an exploded view of installation of a head shaking device provided in a second embodiment of the present disclosure.

As shown in FIG. 4, the head shaking device further includes a rolling body assembly, which is disposed between the fixing assembly 1 and the rotating assembly 2, and is in rolling fit with the fixing assembly 1 and the rotating assembly 2, respectively.

The rolling body assembly supports the rotating assembly 2 above the fixing assembly 1, such that the first connecting structure 11 and the second connecting structure 21 are not in direct contact with each other, so as to prevent damage or noise caused by friction therebetween; and the rotating fit between the fixing assembly 1 and the rotating assembly 2 is realized by the rolling fit between the rotating assembly 2 and the rolling body assembly and the rolling fit between the fixing assembly 1 and the rolling body assembly, and the contact mode in the cooperation process is point contact or line contact, such that the head shaking process of a fan is smoother and more stable.

In the present embodiment, the rolling body assembly is a ball assembly 4, the ball assembly 4 includes a ball plate 41 which is provided with a ball groove, and a ball 42 which is rotatably disposed in the ball groove, and the ball 42 is disposed to protrude from two end surfaces of the ball plate 41. In some embodiments, the ball 42 is spherical.

In the present embodiment, the head shaking device further includes a first friction ring 5 and a second friction ring 6, one end surface of the first friction ring 5 is connected with the rotating assembly 2, and the other end surface thereof is provided with a first slideway matching the ball 42; and one end surface of the second friction ring 6 is connected with the fixing assembly 1, and the other end surface thereof is provided with a second slideway 61 matching the ball 42.

The first friction ring 5 and the second friction ring 6 withstand a frictional force, thereby preventing damage to the fixing assembly 1 and the rotating assembly 2; and in a rotating process of the rotating assembly 2 relative to the fixing assembly 1, the ball 42 is accommodated and limited in the first slideway and the second slideway 62 for moving, such that the stability of the rotating assembly 2 in the head shaking process is better.

In the present embodiment, the first friction ring 5 is provided with at least one positioning block 51 or positioning cavity 53, and the rotating assembly 2 is provided with a matched positioning cavity 23 or positioning block 51; and the second friction ring 6 is provided with at least one positioning block 51 or positioning cavity, and the fixing assembly 1 is provided with a matched positioning cavity or positioning block 51. By means of providing the positioning block 51 and the positioning cavity, the rotating assembly 2 and the first friction ring 5 will not rotate relative to each other, and the installation and disassembly are convenient; and the fixing assembly 1 and the second friction ring 6 will not rotate relative to each other, and the installation and disassembly are convenient.

In some embodiments, the first friction ring 5 is provided with a positioning block 51, and the rotating assembly 2 is provided with a positioning cavity 23, thereby not only enhancing the strength of the first friction ring 5, but also not changing the thickness of the first friction ring 5. The second friction ring 6 is provided with a positioning block 51, and the fixing assembly 1 is provided with a positioning cavity, thereby not only enhancing the strength of the second friction ring 6, but also not changing the thickness of the second friction ring 6.

In some embodiments, the first friction ring 5 is provided with at least three positioning blocks 51, which are evenly distributed in the circumferential direction of the first friction ring 5, and the rotating assembly 2 is correspondingly provided with positioning holes, and the shape and size of the positioning blocks 51 match those of the positioning holes. The second friction ring 6 is provided with at least three positioning blocks 51, which are evenly distributed in the circumferential direction of the second friction ring 6, the fixing assembly 1 is correspondingly provided with positioning holes, and the shape and size of the positioning blocks 51 match those of the positioning holes.

In the present embodiment, one of the rotating assembly 2 and the fixing assembly 1 includes a rotating shaft 22 in the axial direction, and the other includes a shaft hole 13 matching the rotating shaft 22. By means of the cooperation between the rotating shaft 22 and the shaft hole 13, an installation pressure between the first connecting structure 11 and the second connecting structure 21 is shared, meanwhile, the rotary connection between the fixing assembly 1 and the rotating assembly 2 is stabilized, and the head shaking stability is enhanced.

In the present embodiment, the head shaking device further includes a shaft sleeve 7, which is sleeved inside the shaft hole 13 and is sleeved outside the rotating shaft 22.

In the present embodiment, the outer periphery of the shaft sleeve 7 is provided with a limiting portion for fixing the shaft sleeve 7, and the inner periphery of the shaft hole 13 is provided with a matching portion which matches the limiting portion. The limiting portion is a convex block which protrudes from the outer periphery of the shaft sleeve 7 or a pit which is formed in the outer periphery of the shaft sleeve 7, and the matching portion is a matched pit or a convex block. The limiting portion includes at least two protruding ribs which protrude from the outer periphery of the shaft sleeve 7.

Figure 5:
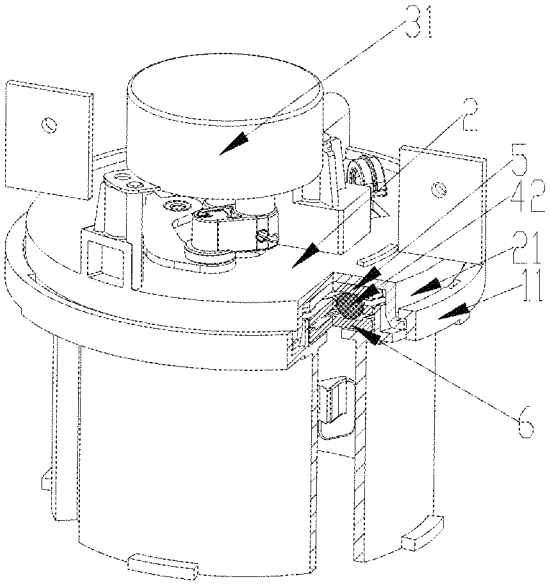
FIG. 5 illustrates a partial sectional view of the head shaking device shown in FIG. 4 of the present disclosure.
Figure 6:
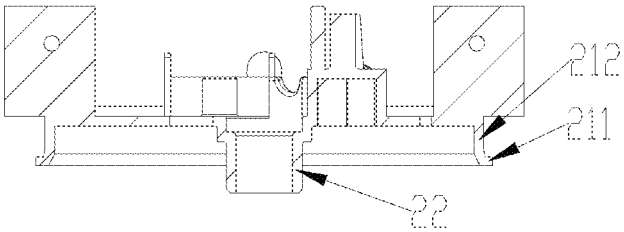
FIG. 6 illustrates a sectional view of a rotating assembly of the present disclosure.
Figure 7:
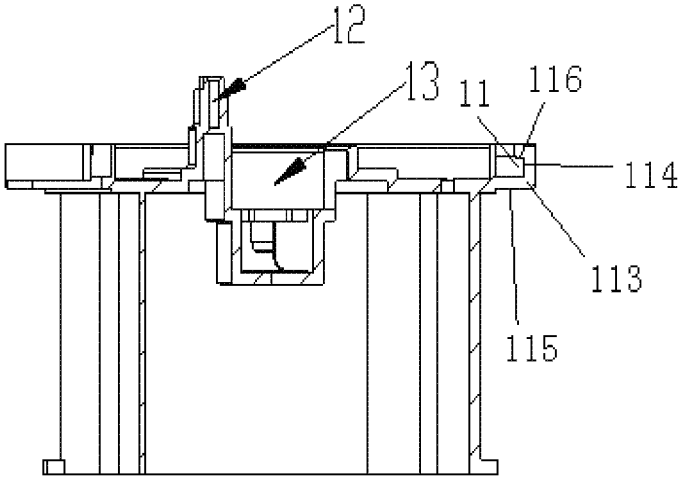
FIG. 7 illustrates a sectional view of a fixing assembly of the present disclosure.

As shown in FIGS. 4-5, the head shaking device further includes a driving assembly 3, which is configured to drive the rotating assembly 2 to rotate relative to the fixing assembly 1 in the reciprocating manner. The driving assembly 3 includes a motor 31, a crank 32 and a connecting rod 33, wherein the motor 31 is installed on the rotating assembly 2, and is provided with an output shaft of motor 31 which is fixedly connected with one end of the crank 32; the other end of the crank 32 is connected with one end of the connecting rod 33, the fixing assembly 1 is provided with a rocker 12 protruding toward the direction of the rotating assembly 2, and the other end of the connecting rod 33 is connected with the rocker 12, so that the crank 32, the connecting rod 33 and the rocker 12 form a four-bar 33 mechanism. Under the driving of the motor 31, the motor 31 controls the output shaft of motor 31 to rotate, so as to drive the other end of the crank 32 to rotate around one end of the crank 32, one end of the crank 32 rotates to drive the connecting rod 33 to move, and the movement of the connecting rod 33 drives the rocker 12 to rotate relative to the fixing assembly 1 in the reciprocating manner, and the rotating assembly 2 rotates relative to the fixing assembly 1 in the reciprocating manner.

The fixing assembly 1 is provided with a rocker 12 protruding toward the direction of the rotating assembly 2, the other end of the connecting rod 33 is provided with a mounting hole, and a fastener is connected with the rocker 12 by means of the mounting hole. The driving assembly 3 is disposed on the other end of the rotating assembly 2 relative to the fixing assembly 1, the rotating assembly 2 is provided with a rotating hole 26 for the rocker 12 to move, and the rocker 12 passes through the rotating hole 26 to be connected with the other end of the connecting rod 33. In an assembly process, the rotating assembly 2 rotates relative to the fixing assembly 1, the rocker 12 moves from one end of the rotating hole 26 to a first position of the rotating hole, and the rotating assembly 2 is rotatably clamped with an assembly assembly; and in a head shaking process, the rotating assembly 2 rotates relative to the fixing assembly 1 in the reciprocating manner, and the rocker 12 reciprocates between the first position of the rotating hole 26 and the other end of the rotating hole 26. Therefore, it is ensured that the rotating assembly 2 and the fixing assembly 1 are maintained in a rotary clamping state. A central angle corresponding to the rotating hole 26 is greater than the second central angle.

Or, the motor 31 is disposed on the other end of the rotating assembly 2 relative to the fixing assembly 1, and the crank 32 and the connecting rod 33 are disposed between the rotating assembly 2 and the fixing assembly 1, the rotating assembly 2 is provided with a through hole, and the output shaft of motor 31 of the motor 31 passes through the through hole to be connected with one end of the crank 32.

The motor 31 is detachably installed on the rotating assembly 2, and specifically includes connection modes such as clamping and threaded connection; an end surface of the rotating assembly 2, which faces away from the fixing assembly 1, is provided with at least one protruding connecting column 24, an outer side wall of the motor 31 is provided with a protruding connecting piece, and the connecting piece is cooperatively connected with the connecting column 24. In some embodiments, the end surface of the rotating assembly 2, which faces away from the fixing assembly 1, further includes at least one limiting column 25, the connecting piece is provided with at least two connecting holes, the limiting column 25 is inserted into one connecting hole, and a fastener cooperates with the connecting column 24 by means of another connecting hole. In some embodiments, the end surface of the rotating assembly 2, which faces away from the fixing assembly 1, is provided with two protruding connecting columns 24 and two limiting columns 25, the outer side wall of the motor 31 includes two connecting pieces, and the two connecting pieces are disposed opposite to each other.

An end surface of the motor 31, which faces the fixing assembly 1, is provided with a protruding output shaft of motor 31, and the output shaft of motor 31 includes a through hole perpendicular to the axial direction of the output shaft of motor 31; and one end of the crank 32 is provided with an insertion hole into which the output shaft of motor 31 is inserted, a side wall of the insertion hole is provided with a through hole which cooperates with the through hole of the rotating shaft, and a fastener passes through the two through holes to connect the output shaft of motor 31 to one end of the crank 32.

The two ends of the connecting rod 33 are provided with connecting through holes, and a fastener passes through the connecting through holes to be connected with the other end of the crank 32. In some embodiments, the other end of the crank 32 includes a protruding portion 212 that cooperates with the connecting through holes, the protruding portion 212 is inserted into the connecting through holes, and the connecting rod 33 is connected with the crank 32 by a screw.

In the present embodiment, a fan is further provided, including the above-mentioned head shaking device.

In some embodiments, the fan with the head shaking device in the present embodiment may be a tower fan or an oscillating fan, or other household appliances or devices, which need to shake heads.

Obviously, the above-mentioned embodiments are only examples for clear description, and are not limitations to the embodiments. For those of ordinary skill in the art, on the basis of the above description, other different forms of changes or modifications may also be made. It is unnecessary and impossible to enumerate all the embodiments herein. Obvious changes or modifications derived herein are still within the protection scope of the present disclosure.

What is claimed:

1. A head shaking device, comprising:

a fixing assembly; and a rotating assembly, which rotates relative to the fixing assembly in a reciprocating manner, wherein one of the fixing assembly and the rotating assembly-comprises at least one first connecting structure, the other comprises at least one second connecting structure, and the first connecting structure is rotatably clamped with the second connecting structure;

wherein the first connecting structure comprises a first rotary clamping protrusion, the second connecting structure comprises a second rotary clamping protrusion, the first connecting structure forms a clamping space on one side on which the first rotary clamping protrusion faces away from the second connecting structure, the first rotary clamping protrusion is disposed on one side of the second rotary clamping protrusion along a direction of a rotation axis of the rotating assembly, the second rotary clamping protrusion is limited in the clamping space and can rotate relative to the first rotary clamping protrusion, wherein one of an axial direction of the rotating assembly and an axial direction of the fixing assembly comprises a rotating shaft in an axial direction, and the other of the axial direction of the rotating assembly and the axial direction of the fixing assembly comprises a shaft hole cooperated with the rotating shaft;

wherein the head shaking device further comprises a shaft sleeve, which is sleeved inside the shaft hole and is sleeved outside the rotating shaft, an outer periphery of the shaft sleeve is provided with a limiting portion for fixing the shaft sleeve, and an inner periphery of the shaft hole is provided with a matching portion which is cooperated with the limiting portion.

2. The head shaking device as claimed in claim 1, wherein a central angle corresponding to an assembly path, on which the rotating assembly rotates relative to the fixing assembly so as to realize rotary clamping, is a first central angle, a central angle corresponding to a head shaking path, on which the rotating assembly rotates relative to the fixing assembly in the reciprocating manner, is a second central angle, and at least part of the first central angle does not coincide with the second central angle.

3. The head shaking device as claimed in claim 2, wherein the second rotary clamping protrusion has an assembly state in which at least part of the second rotary clamping protrusion rotates into the clamping space when rotating by the first central angle, and a head shaking state in which at least part of the second rotary clamping protrusion is limited in the clamping space when rotating by the second central angle in the reciprocating manner.

4. The head shaking device as claimed in claim 1, wherein the second rotary clamping protrusion has a first state of being limited in the clamping space, and a second state of deviating from the clamping space.

5. The head shaking device as claimed in claim 4, wherein the first connecting structure comprises a rotating groove, the first rotary clamping protrusion is a groove wall of the rotating groove, and the second rotary clamping protrusion has the first state of being limited in the rotating groove, and the second state of deviating from the rotating groove.

6. The head shaking device as claimed in claim 5, wherein the first connecting structure further comprises inlet grooves, each of the inlet grooves at least communicates with one rotating groove, and the second rotary clamping protrusion enters the rotating groove by means of the inlet groove.

7. The head shaking device as claimed in claim 6, wherein the inlet groove communicates with the rotating groove in a circumferential direction, so as to form a groove-shaped structure with an opening which faces an axis of the rotating assembly, and the second rotary clamping protrusion protrudes toward a direction away from the axis of the rotating assembly.

8. The head shaking device as claimed in claim 7, wherein the fixing assembly comprises the at least one first connecting structure, the at least one first connecting structure is distributed in a circumferential direction of the fixing assembly and communicate with each other in sequence, and the inlet groove and the rotating groove form an annular groove with an opening which faces the axis of the rotating assembly.

9. The head shaking device as claimed in claim 8, wherein the at least one first connecting structure are disposed on a radial edge of the fixing assembly and are evenly distributed in the circumferential direction of the fixing assembly; and the second connecting structures are correspondingly disposed on a radial edge of the rotating assembly and are evenly distributed in a circumferential direction of the rotating assembly.

10. The head shaking device as claimed in claim 9, wherein the fixing assembly comprises a fixing body, and a flange disposed on one end of the fixing body which faces the rotating assembly, and the flange protrudes from an outer peripheral wall of the fixing body; an end wall of the flange, which faces away from the rotating assembly, forms a first groove wall of the annular groove; an outer peripheral wall of the flange forms a groove bottom wall of the annular groove; and one end of the flange, which faces the rotating assembly, extends toward the axis of the rotating assembly, so as to form a second groove wall of the annular groove.

11. The head shaking device as claimed in claim 10, wherein the second groove wall is provided with at least one notch, the annular groove located at the notch is the inlet groove, and the second rotary clamping protrusion enters the inlet groove by means of the notch.

12. The head shaking device as claimed in claim 11, wherein the notch extends from an opening of the annular groove toward the direction of the groove bottom wall of the annular groove, so as to form an arc-shaped notch, and a shape of the second rotary clamping protrusion matches a shape of the notch.

13. The head shaking device as claimed in claim 10, wherein an end surface of the rotating assembly, which faces the fixing assembly, is provided with a protruding portion which protrudes toward the fixing assembly, and the second rotary clamping protrusion is disposed on an outer peripheral wall of the protruding portion.

14. The head shaking device as claimed in claim 13, wherein the protruding portion is annular, and the second rotary clamping protrusion is disposed on one end of the outer peripheral wall of the protruding portion, which is away from the rotating assembly.

15. The head shaking device as claimed in claim 1, wherein the head shaking device further comprises a rolling body assembly, which is disposed between the fixing assembly and the rotating assembly, and is in rolling cooperate with the fixing assembly and the rotating assembly, respectively.

16. The head shaking device as claimed in claim 15, wherein the rolling body assembly is a ball assembly, the ball assembly comprises a ball plate which is provided with a ball groove, and a ball which is rotatably disposed in the ball groove, and the ball is disposed to protrude from two end surfaces of the ball plate.

17. The head shaking device as claimed in claim 16, wherein the head shaking device further comprises a first friction ring-and a second friction ring, one end surface of the first friction ring is connected with the rotating assembly, and the other end surface thereof is provided with a first slideway matching the ball; and one end surface of the second friction ring is connected with the fixing assembly, and the other end surface thereof is provided with a second slideway matching the ball.

18. The head shaking device as claimed in claim 17, wherein the first friction ring is provided with at least one positioning block or at least one positioning cavity, and the rotating assembly is provided with a positioning cavity cooperated with the at least one positioning block or a positioning block cooperated with the at least one positioning cavity; and the second friction ring is provided with the at least one positioning block or the at least one positioning cavity, and the fixing assembly is provided with the positioning cavity cooperated with the at least one positioning block or positioning block cooperated with the at least one positioning cavity.

19. A fan, comprising the head shaking device as claimed in claim 1.

* * * * *